US006874652B2

(12) United States Patent
Christensen et al.

(10) Patent No.: US 6,874,652 B2
(45) Date of Patent: Apr. 5, 2005

(54) METHODS FOR DISPENSING OF TABLETS FROM AN APPARATUS, APPARATUSES FOR PERFORMING THE METHODS AND USE OF SUCH APPARATUSES

(75) Inventors: Henrik Bondgaard Christensen, Risskov (DK); Henrik Hougaard Vilstrup, Holstebro (DK); Ole Hangaard, Arhus N (DK); Keld Sloth Christensen, Hjerm (DK); Kim Bisgaard Sorensen, Arhus N (DK)

(73) Assignee: Bang & Olufsen Medicom A/S, Struer (DK)

( * ) Notice: Subject to any disclaimer, the term of this patent is extended or adjusted under 35 U.S.C. 154(b) by 54 days.

(21) Appl. No.: 10/363,944

(22) PCT Filed: Sep. 7, 2001

(86) PCT No.: PCT/DK01/00586

§ 371 (c)(1),
(2), (4) Date: Jul. 10, 2003

(87) PCT Pub. No.: WO02/20369

PCT Pub. Date: Mar. 14, 2002

(65) Prior Publication Data

US 2004/0099561 A1 May 27, 2004

(30) Foreign Application Priority Data

Sep. 7, 2000 (DK) ..... 200001338

(51) Int. Cl.[7] ..... G07F 11/72
(52) U.S. Cl. ..... 221/30; 221/88

(58) Field of Search ..... 221/25, 26, 30, 221/31, 74, 86, 88; 206/531, 532, 534

(56) References Cited

U.S. PATENT DOCUMENTS

| | | | | |
|---|---|---|---|---|
| 3,437,236 | A | * | 4/1969 | Huck ..... 206/534 |
| 3,800,940 | A | | 4/1974 | Thomas |
| 3,984,031 | A | | 10/1976 | Thompson |
| 4,015,717 | A | | 4/1977 | Richardson et al. |
| 4,437,579 | A | | 3/1984 | Obland |
| 4,733,797 | A | | 3/1988 | Haber |
| 5,409,132 | A | | 4/1995 | Kooijmans et al. |
| 5,816,406 | A | | 10/1998 | Seidler |
| 6,062,420 | A | | 5/2000 | Krouwel et al. |
| 6,098,835 | A | | 8/2000 | DeJonge |

FOREIGN PATENT DOCUMENTS

| | | |
|---|---|---|
| DE | 3922763 | 1/1991 |
| WO | 9747534 | 12/1997 |
| WO | 0009419 | 2/2000 |
| WO | 0043287 | 7/2000 |

* cited by examiner

*Primary Examiner*—Kenneth Noland
(74) *Attorney, Agent, or Firm*—Harness, Dickey & Pierce, PLC

(57) ABSTRACT

The present invention relates to methods for dispensing of tablets from an apparatus constituting a dispenser for tablets contained in a blister pack. The invention also relates to such apparatuses and to uses of such apparatuses. The invention makes use of an apparatus the operating of which greatly increases the facility of using the apparatus, increases the resistance towards tampering the apparatus and facilitates reducing the size of the apparatus when not in use.

44 Claims, 10 Drawing Sheets

Figure 1:
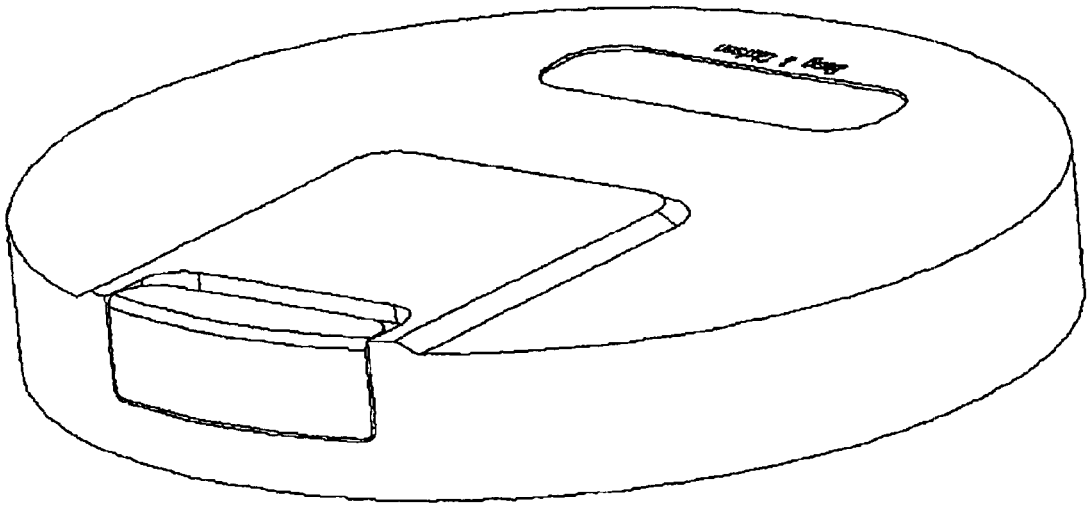

METHODS FOR DISPENSING OF TABLETS FROM AN APPARATUS, APPARATUSES FOR PERFORMING THE METHODS AND USE OF SUCH APPARATUSES

The present invention relates to methods for dispensing of tablets from an apparatus constituting a dispenser for tablets in a blister pack. The invention also relates to apparatuses for performing the methods and relates to use of such apparatuses.

The term tablets is used as a description of any type of medication or other dosage collections that are to be dosed to a person at regular intervals. Accordingly, the dosage collections could be pills, capsules and other types of shaped dosage collections. The term blister packs is used as a description of any type of packaging having more than a flat shape for enclosing of individual dosage collections for dispensing from a tablet dispenser.

U.S. Pat. No. 5,431,283 describes an opener for blister packs. The opener consists of three parts. A first part is for pushing tablets out of the blister pack. A second part is for positioning the blister pack in relation to the first part and in relation to a third part. The third part is for cutting a foil of the blister pack before the tablet within the blister pack is pushed out of the blister pack. When using the opener the blister pack is positioned manually in relation to the second part before the third part and the first part is used for cutting the blister pack and for pushing the tablet out of the blister pack.

The opener described above has some disadvantages. Firstly, the cutting of the blister pack and the subsequent pushing out of the tablet in the blister pack takes place stepwise, i.e. is performed in two steps. This means that there is the risk of trying to push the tablet out of the blister pack by means of the first part before the foil of the blister pack is cut by the third part. Secondly, the mutual distance that the first part and the third part has to travel in relation to each other is relatively long compared to the rather simple performance of having a tablet pushed out of a blister pack. Thirdly, it may be difficult to manually position the blister pack in relation to the second part and to manually maintain the positioning in relation to the second part while at the same time having to operate the first part and the third part. Fourthly, the opener does not contain the blister pack and therefore it will be necessary for a patient having to take the medication of the tablets to bring along both the opener and the blister pack, but separately.

U.S. Pat. No. 5,464,118 describes an apparatus also for removing as example tablets from blister packs. The apparatus comprises a bottom part, a top part and a bearing part. The bearing part and the bottom part are provided with recesses for taking up of tablets within a blister pack. The top part is provided with a plunger for pushing out of tablets from the blister pack when the top part and the bottom part are displaced telescopically in relation to each other. The plunger of the top part uses the boundaries of the bottom part as rest when breaking the foil of the blister pack and when pushing the tablet out of the blister pack.

The apparatus described herein also has some disadvantages. Firstly, using only the boundaries of the recesses of the bottom part involves the risk of making it difficult to break the integrity of the foil of the blister pack. Accordingly, in stead of pushing out of the tablet, there is a risk of crushing the tablet within the blister pack before the foil of the blister pack is broken. Secondly, because of the intermediate part and the bottom part having recesses at chosen locations around the circumference of the blister pack, it is only possible to use blister packs with the right diameter, with the right number of tablets per pack and with the tablets disposed in the pack in the right distance from the centre of the pack. Thirdly, depending on the diameter of the blister pack and accordingly of the apparatus it may be difficult to displace the top part and the bottom part in relation to each other because of the risk of unequal displacement. Fourthly, it is still necessary to manually operate the apparatus in order to have the tablets removed from the blister pack and assembling of the bottom part and the top part takes place by manually screwing the two parts together which may be difficult for disabled or elderly people.

It is an object of the present invention to eliminate or at least to minimise the problems of the methods and the apparatuses discussed above by making it easier and more safe to have tablets dispensed from a dispenser for blister packs, both safe in relation to not damaging the tablets and safe in relation to the patient having easy access to the medication contained in the tablets.

The object may be obtained by a method for dispensing of tablets from an apparatus constituting a container and a dispenser for tablets in a blister pack, said method comprising the steps of releasing the apparatus from a locked state to an unlocked state, activating dispensing means in the apparatus for dispensing of at least one tablet, dispensing said tablet from the apparatus through an outlet in the apparatus, and reverting the apparatus from the unlocked state to the locked state.

By providing a method where the apparatus can be released from a locked state to an unlocked state and visa versa there is an opportunity of locking the dispenser when the dispenser is not in use avoiding unintentional dispensing of tablets from the dispenser. Furthermore, the dispenser will be more resistant towards tampering by children or any other persons whom the user may want to prevent from tampering the dispenser. Still further, a dispenser having a locked state and an unlocked state makes it possible to reduce the size of the dispenser when in the locked state in which the dispenser is not in use and only establishing the full size of the dispenser when in use in the unlocked state.

The object may alternatively be obtained by a method for dispensing of tablets from an apparatus constituting a container and a dispenser for tablets in a blister pack, said method comprising the steps of activating a manually operated activation means of the apparatus, the manually operated activating means activating automatic displacement means, and the automatic displacement means displacing the blister pack inside the dispenser.

By a combination of manually operated means and automatically operated means, it is ensured that only when the user manually operates the manually operated means, a tablet will be dispensed, but the manual operation being limited and other operations being performed automatically, thereby facilitating the use of the apparatus.

The methods may preferably be performed manually and being capable of being performed using only one hand, more preferably being capable of being performed using the palm of the hand and being performed not using the fingers of the hand.

By enabling use only of one hand and preferably the palm of the hand, the use of the apparatus is facilitated by users only having limited muscular strength such as elderly people, disabled people or people in other ways having difficulties using both hands and perhaps also having difficulties using the fingers.

An apparatus for performing the alternative method and for dispensing of tablets from a blister pack comprises a compartment for containing the blister pack with a number of tablets enclosed therein, and comprising means at least for pushing the tablet out of the blister pack, and comprising an outlet for dispensing of at least one tablet from the blister pack and further out of the apparatus and said apparatus furthermore comprising means for automatically displacing the blister pack within the compartment.

As mentioned before, the combination of manually operated means and automatically operated means facilitates the users operation of the apparatus, but also ensures that unintentional use of the apparatus is obtained, because the automatically operated means only will be activated after the manually operated means has been activated.

DETAILED DESCRIPTION OF THE INVENTION

Figure 2:
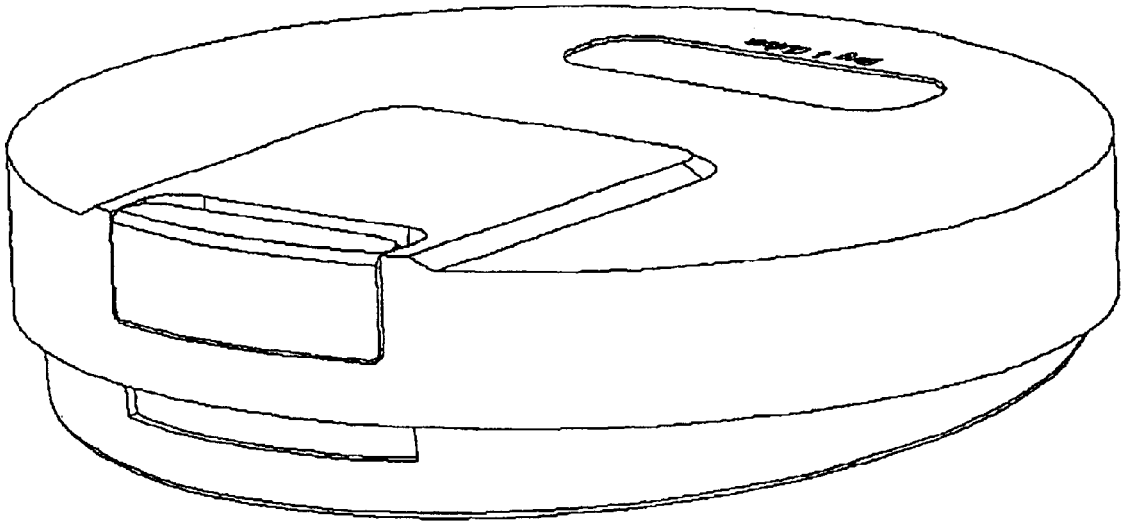
Figure 3:
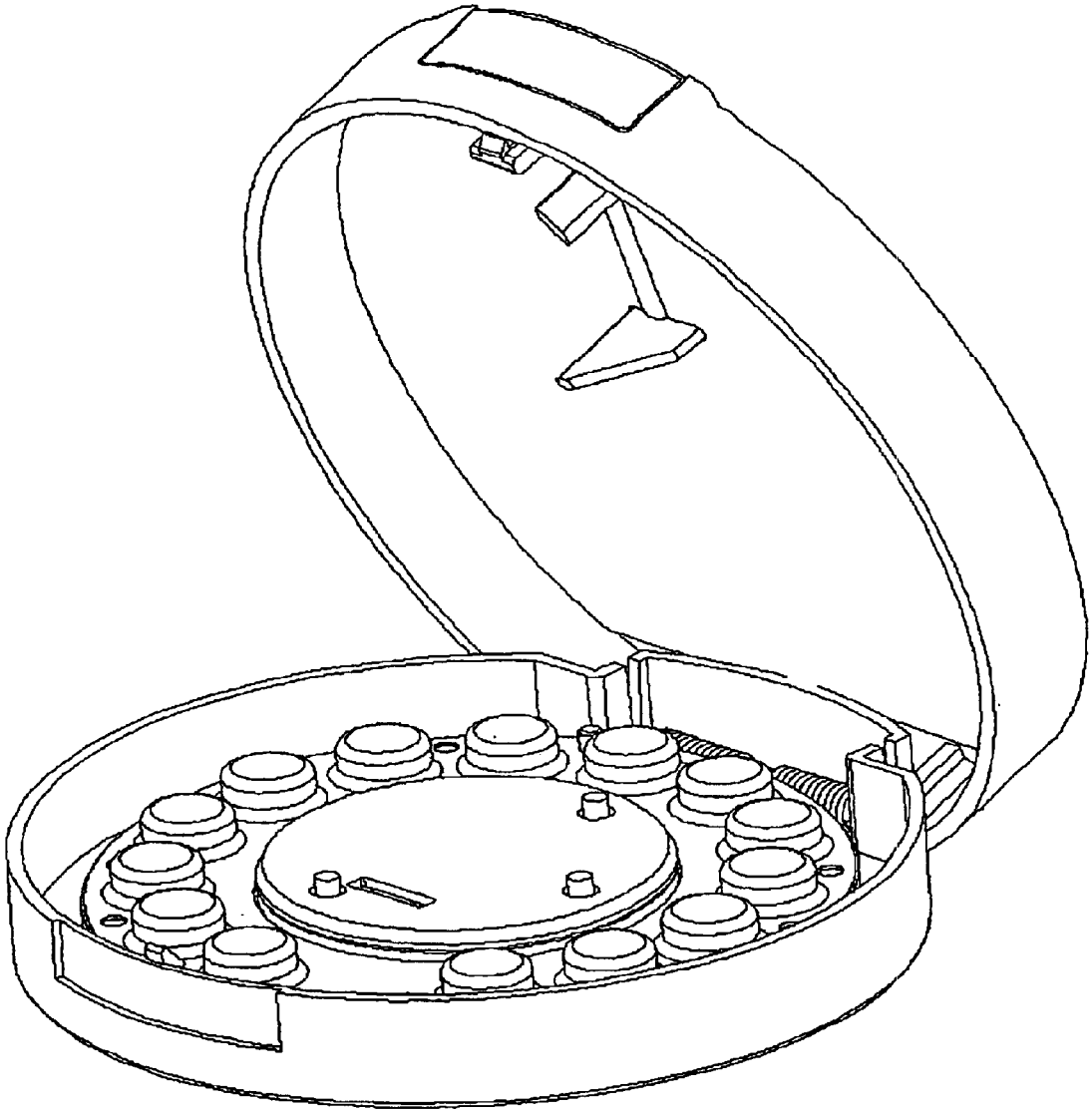
Figure 4:
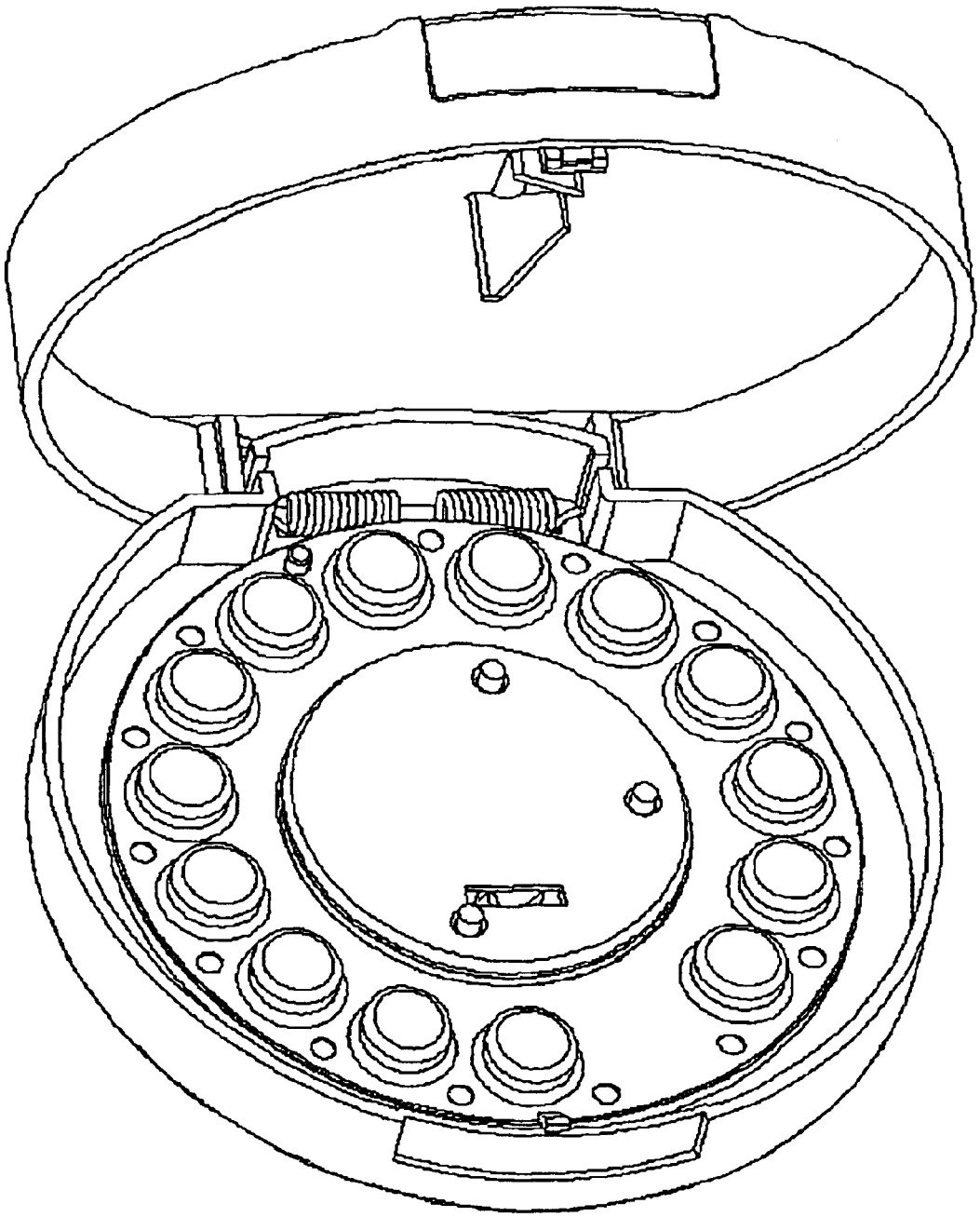
Figure 5:
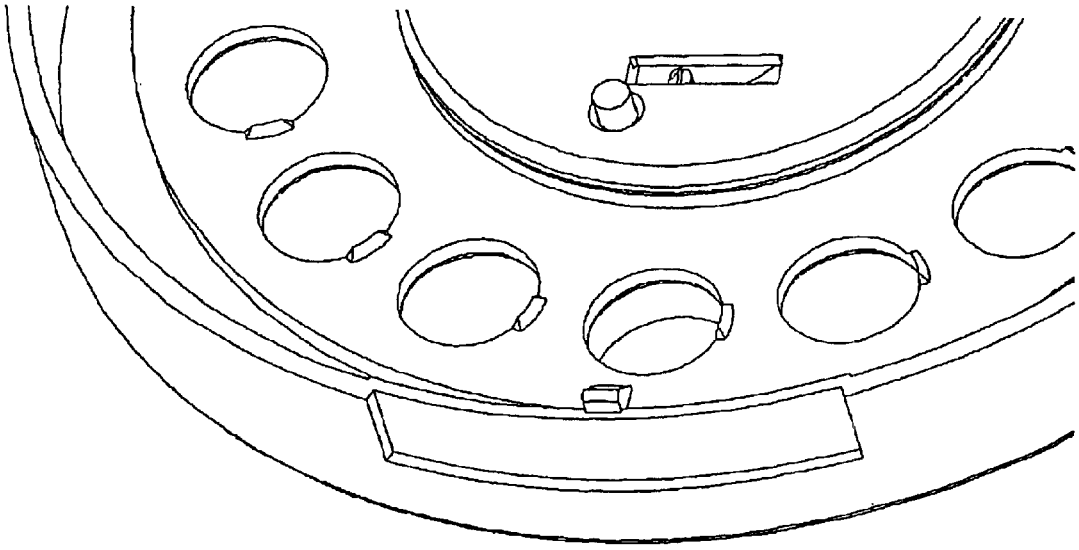
Figure 6:
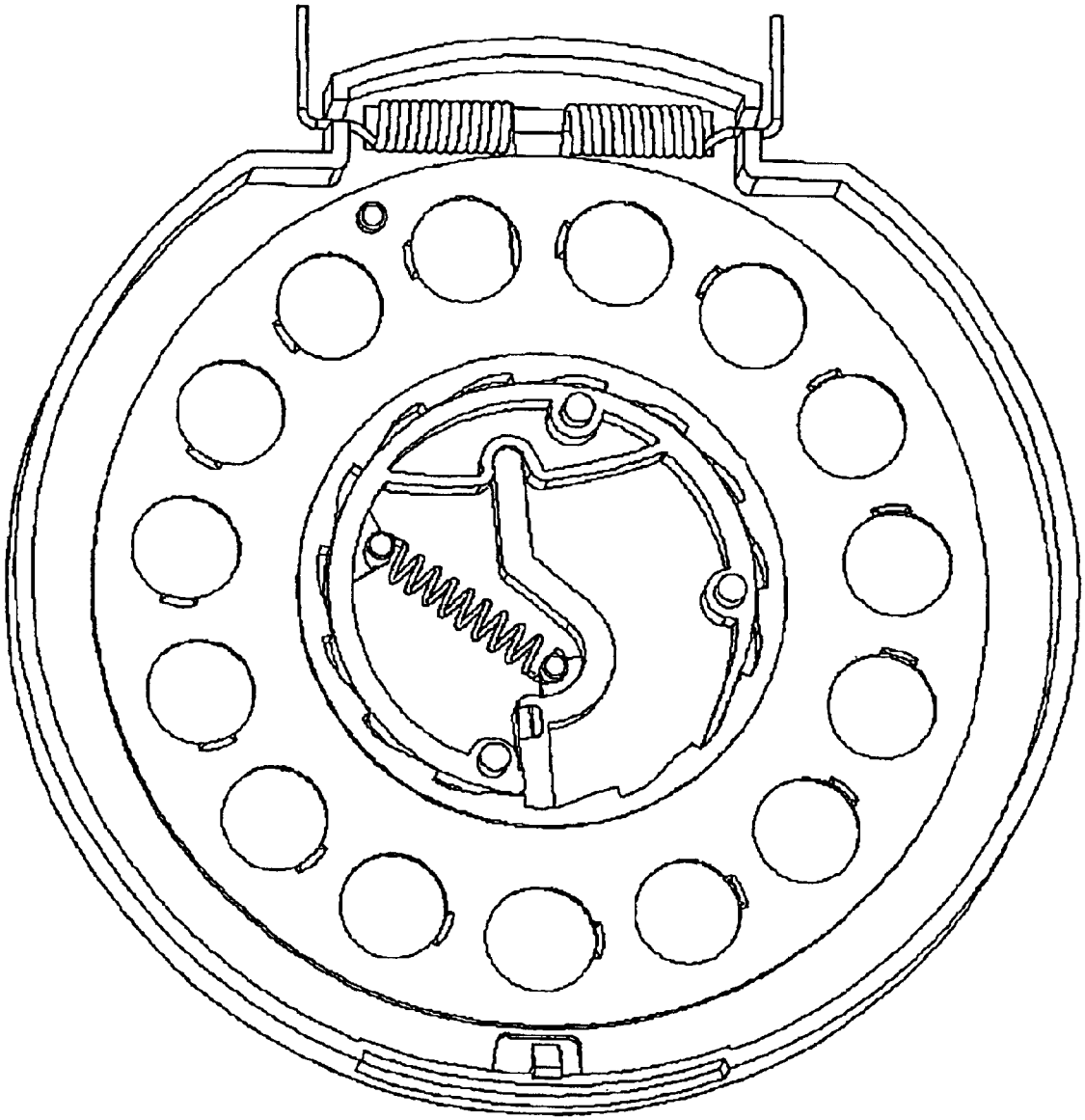
Figure 7:
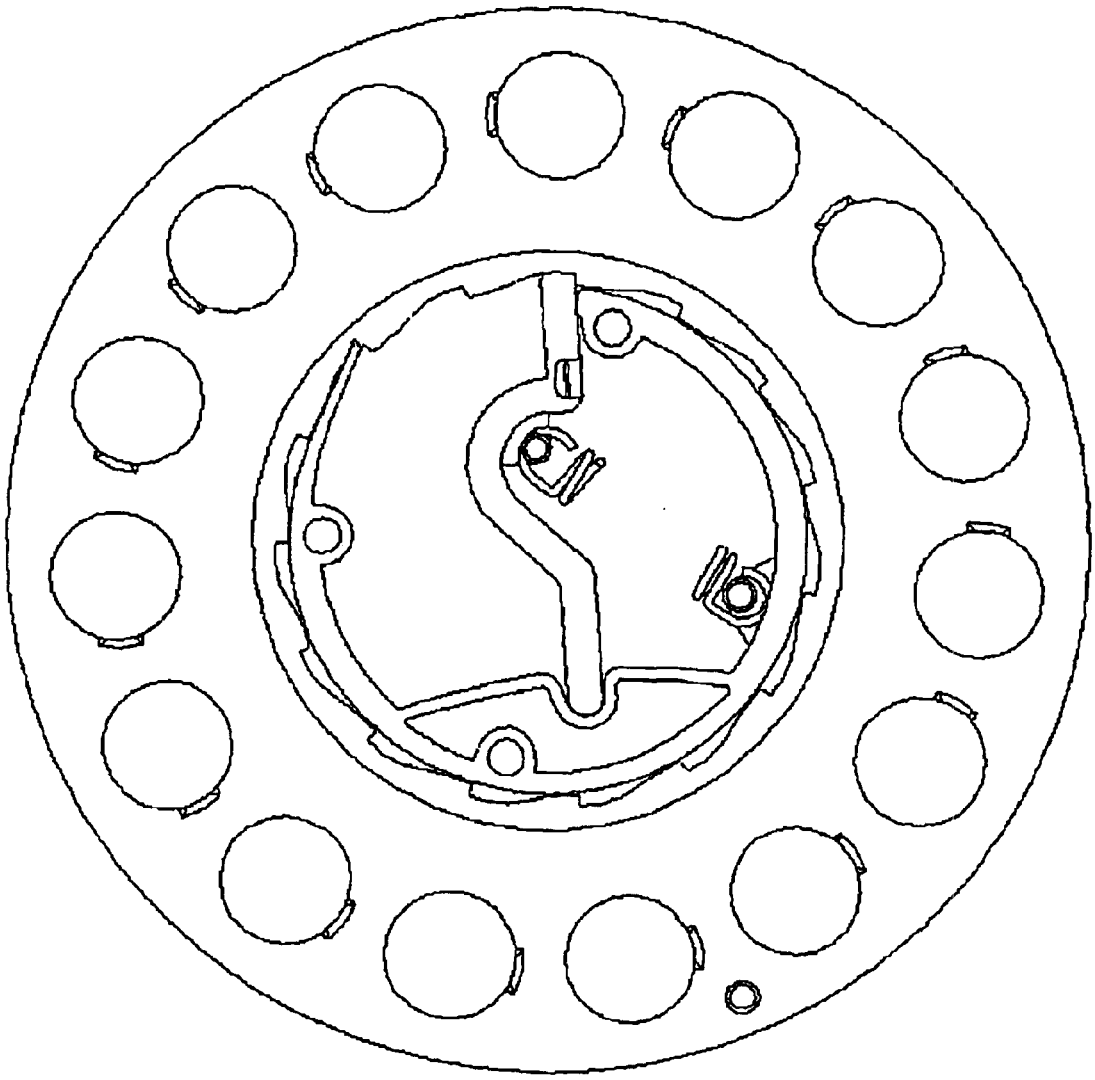
Figure 8:
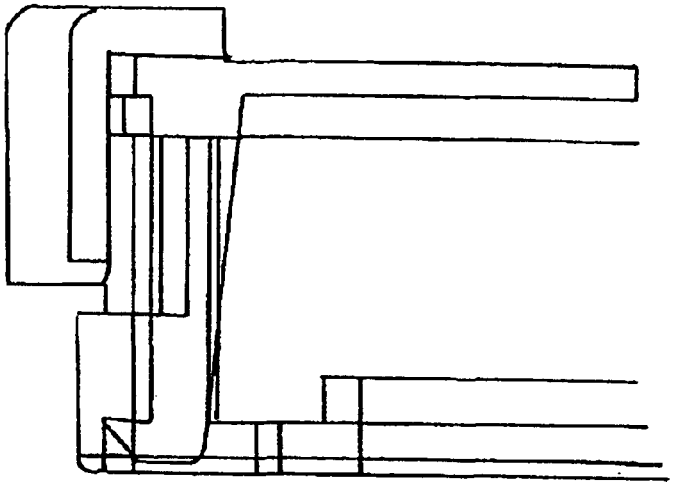
Figure 9:
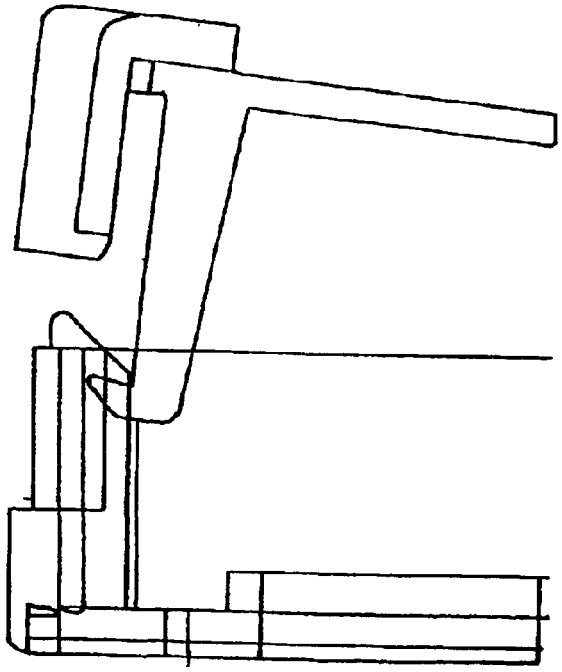
Figure 10A:
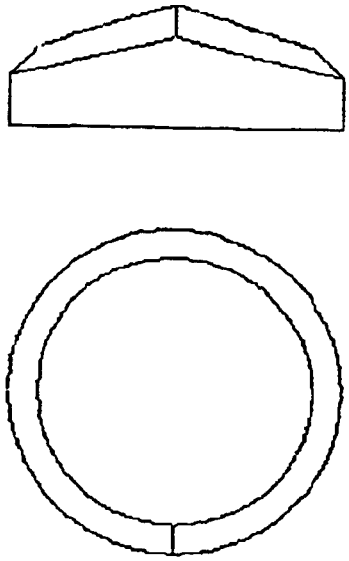
Figure 10B:
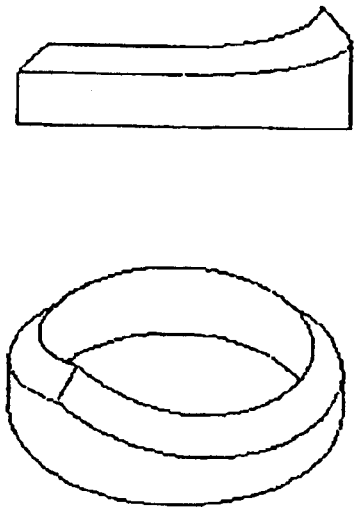
Figure 10C:
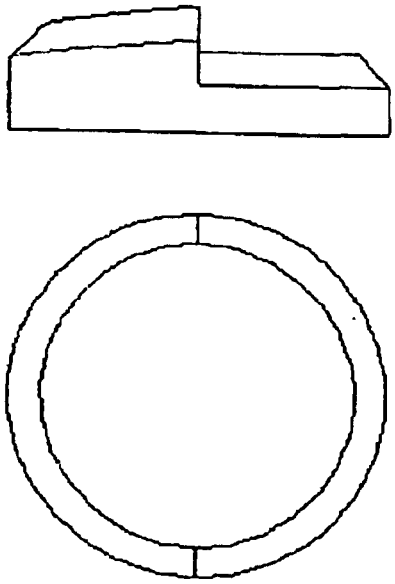
Figure 10D:
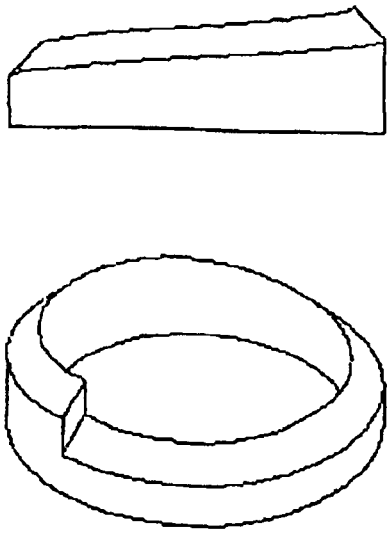
Figure 11A:
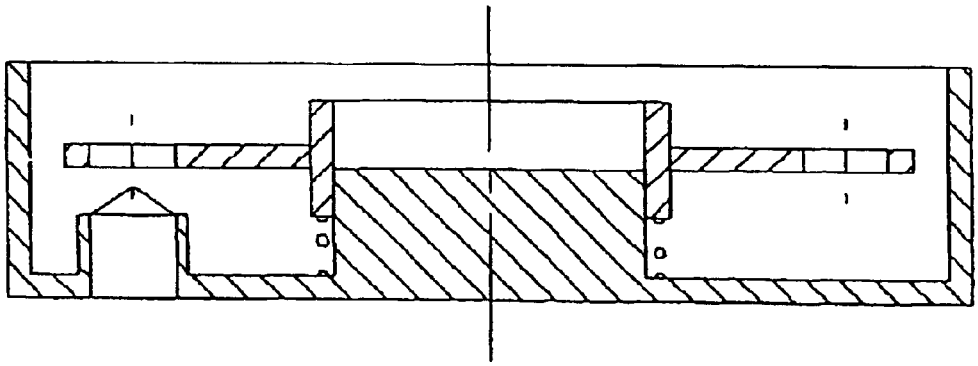
Figure 11B:
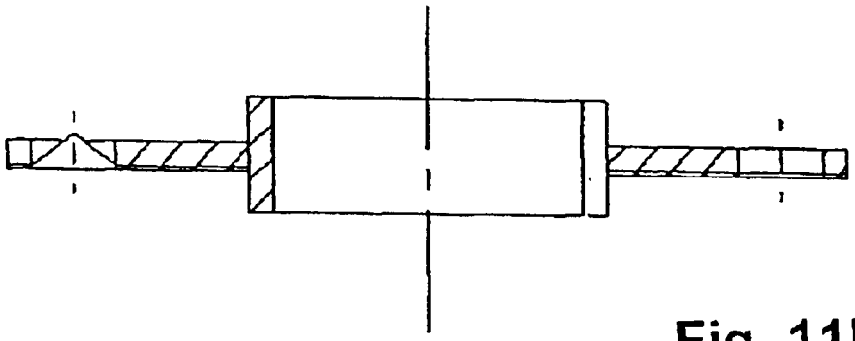
Figure 11C:
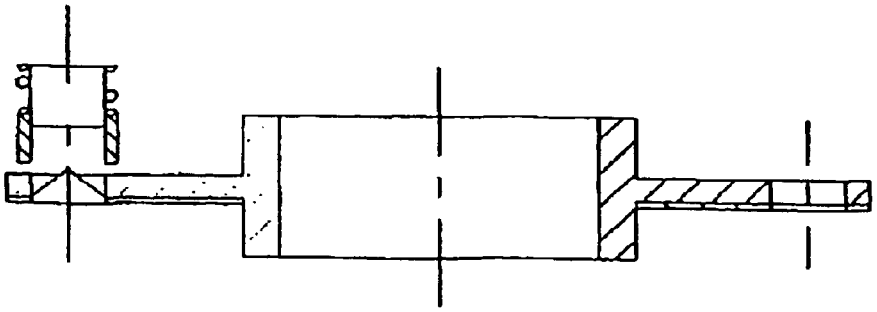

Hereafter, the invention will be described in details with reference to the accompanying drawings, where FIG. 1 is a perspective view of a dispenser according to the invention in a fully closed state in which the dispenser is not in use as dispenser FIG. 2 is a perspective view of a dispenser according to the invention in a partly closed state being a state where the dispenser is about to be used as dispenser FIG. 3 is a first perspective view of a dispenser according to the invention in an fully opened state being a state where the dispenser may be loaded with a blister pack FIG. 4 is a second perspective view of a dispenser according to the invention in a fully opened state being the state where the dispenser may be loaded with a blister pack FIG. 5 is a perspective view of details of the bottom part of the dispenser according to the invention FIG. 6 is a perspective view of a bottom part of the dispenser according to the invention FIG. 7 is a drawing of a driving mechanism in the bottom part of the dispenser according to the invention FIG. 8 is a first sketch of the function of a release button when the dispenser is in a fully closed state, FIG. 9 is a second sketch of the function of the release button when the dispenser is a partly closed state, FIGS. 10A–10D are different embodiments of cutting edges of lands for initially cutting the blister pack before dispensing the tablet, and FIGS. 11A–11C are different embodiments of cutting means also for initially cutting the blister pack before dispensing the tablet FIG. 1 shows an embodiment of a dispenser according to the invention. The dispenser comprises a bottom part and a top part. The top part is provided with a release button for enabling use of the dispenser. The use of the dispenser will be explained later. The dispenser constitutes a container for a blister pack (see FIG. 3 and FIG. 4) containing tablets to be taken in dosages, said dispenser providing a compartment for the blister pack between the top part and the bottom part. The dispenser is shown in a fully closed state. The fully closed state is the state when the dispenser is not immediately ready for use and is the state when the dispenser is used just for storing the blister pack and when taking the dispenser along in a pocket, a bag in the car or in any other way a user taking the dispenser along. In the fully closed state, the size of the dispenser is smaller than in a partly closed state (see FIG. 2), in which partly closed state the dispenser may be used to dispense tablets.

FIG. 2 shows the dispenser in a partly closed state. This state is obtained by releasing the release button partly (see FIG. 8). In the partly closed state, the top part is lifted a little in relation to the bottom part. The top part is hinged to the bottom part (see FIG. 4) so that the opening of the dispenser takes place like opening an oyster. The partly closed state is the initial state before using the dispenser for dispensing tablets from the blister pack. In the partly closed state, in which state the dispenser, as mentioned, may be used to dispense tablets, the size of the dispenser is greater than in the fully closed state (see FIG. 1).

FIG. 3 shows the dispenser in a fully opened state. This state is obtained by releasing the release button fully (see FIG. 8). In the fully opened state, the top part is completely raised in relation to the bottom part. The fully opened state is the state when taking a used blister pack out of the dispenser and/or when loading the dispenser with a blister pack.

The bottom part and the top part constitute a compartment for containing the blister pack. The blister pack is an annular shaped pack having fourteen blisters each containing a tablet to be taken as a dosage of medication. A different number than fourteen blisters and tablets can be used, however establishing a need for correspondingly substituting a supporting plate (see FIG. 5 and FIG. 6). Between two of the blisters a space is provided.

When loading the blister pack, a space between two blisters is to be placed over an outlet provided in the bottom part (see FIG. 5).

However, after having loaded the blister pack and after the top part and the bottom part are mutually displaced in order to close the dispenser, the blister pack will be rotated counter-clockwise so that a blister will be placed over the outlet in the bottom part such as shown in the drawing. The bottom part is provided with a central section containing a driving mechanism for rotating the blister pack (see FIG. 5) and having an outer diameter. The blister pack being annular shaped is accordingly provided with a central opening. The opening has an inner diameter corresponding to the outer diameter of the central section.

The top part is provided with the release button. The top part has an inner surface being provided with plunger means and displacement means. The plunger means is intended for pushing a tablet out of the blister pack when the top part is fully closed in relation to the bottom part. The displacement means is intended for displacing a lever arm (see FIG. 5) constituting a part of the driving mechanism, said displacement of the lever arm taking place when the top part and the bottom part are mutually displaced to a state where the dispenser is in its closed state as shown in FIG. 1. The displacement means has an inclined side edge intended for mutual co-operation with an abutment surface provided on the lever arm (see FIG. 6).

FIG. 4 shows the dispenser in a fully opened state seen in another perspective view than in FIG. 3. A hinged connection between the top part and the bottom part comprises an axle around which the top part rotates in relation to the bottom part. The hinged connection also comprises a resilient member in the shape of a coil spring. The resilient member is intended for biasing the top part apart from the bottom part, i.e. forcing the top part towards its full opened state in relation to bottom part.

The central section is provided with a cover. The cover is covering the driving mechanism (see FIG. 5) being provided in the central section of the dispenser. The cover is provided with a slot. The slot is intended for allowing the displacement means to pass through the cover when the top part is closed in relation to the bottom part. Through the cover three pins extend. These three pins are intended for fixation in relation to the bottom part of a fixed member (see FIG. 5) constituting a part of the driving mechanism. Through the blister pack just beneath the left part of the hinged connection a fourth pin extends. This fourth pin is intended for fixation of the blister pack in relation to a blister supporting plate (see FIG. 5).

FIG. 5 shows a detail of FIG. 4 seen in another perspective view than in FIG. 4. The cover is in place over the driving mechanism and two of the three pins are shown extending through the cover. The slot provided in the cover is also shown. A supporting plate is shown without the blister pack being placed on the supporting plate. The supporting plate is intended for supporting the blister pack. The supporting plate is provided with holes extending though the supporting plate and being provided along an annular path. The holes have a mutual distance corresponding to the mutual distance between the blisters of the annular shaped blister pack, and the holes have a diameter being greater than the diameter of tablets contained in the blisters of the blister pack.

Each of the holes in the supporting plate is provided with a small cutting edge protruding from the supporting plate and placed along the right side of the holes. However, the cutting edges could be provided along any of the edges of the hole. The cutting edges are intended for initially perforating the blister pack by cutting through the bottom foil of the blister pack when the plunger is pushed towards the top foil of the blister containing the tablet to be dispensed. The dispensing of the tablet is eased, when the blister pack is initially perforated by the cutting edge along the side of the corresponding hole in the supporting plate.

The bottom part is provided with an outlet though which the tablet contained in the blister just above the outlet is pushed out by the plunger when the plunger is pushed towards the blister. The outlet in the bottom part has a diameter being at least the same as, and preferably greater than, the diameter of the holes in the supporting plate. The outlet may have a height that is greater than a height of the tablets to be dispensed through the outlet. Thereby, it is possible to push the tablet out of the outlet by placing the bottom part of the dispenser on a table and by use of the entire force of the palm of a user's hand to push the top part against the bottom part resting on the table. The tablet will be dispensed through the outlet, but the tablet will be kept in the outlet until the dispenser is lifted from the table. The possibility to keep the tablet in the outlet is especially advantageous, when the tablet is to be dispensed by users having reduced muscular strength such as elderly or disabled people. They may use the table as opposing means to the force exerted by them onto the top part.

FIG. 6 shows the bottom part with the driving mechanism for automatically rotating the blister pack. The driving means is constituted by a fixed member, a toothed inner circumference being part of the supporting plate, a lever arm and a spring. The spring member is attached between the fixed member and the lever arm at attachment points of the fixed member and the lever arm. The fixed member is provided with a resilient tongue being intended for engagement with one of the teeth of the toothed inner circumference. The resilient tongue ensures that the toothed inner circumference, and hence the supporting plate and the blister pack, only can be rotated clockwise. However, the fixed member may be provided with a rewind function so that if the supporting plate with the toothed inner circumference is rotated unintentionally, a rewind function is capable of releasing the engagement between the resilient tongue of the fixed member and the toothed inner circumference, and the supporting plate can be rewind.

A distant end of the lever arm is suspended in the fixed member. An end of the lever arm is also in engagement with one of the teeth of the toothed inner circumference. The end of the lever arm is intended for rotating the toothed inner circumference in a counter-clockwise direction by means of the spring member. The lever arm is provided with a small declining abutment surface provided on the left side of the lever arm between the end of the lever arm and the attachment point of the spring member. The abutment surface is intended as abutment surface of the inclined side edge of the displacement means (see FIG. 3 and FIG. 4), that is provided on the inner surface of the top part.

FIG. 7 is a drawing showing in detail the different elements of the driving means. As mentioned in the description of FIG. 6, the end of the lever arm is also in engagement with one of the teeth of the toothed inner circumference. However, a stop for the end of the lever arm is provided on the fixed member. Thus, the lever arm is only capable of rotating the toothed inner circumference clockwise, if the end of the lever arm, before rotating the toothed inner circumference, is being displaced from the stop in a counter-clockwise direction a circumferential distance at least being the circumferential distance between neighbouring teeth of the toothed inner circumference, i.e. is moved counter-clockwise past the tooth in the immediate vicinity of the stop seen in the counter-clockwise direction.

Displacement of the lever arm in the counter-clockwise direction takes place when the top part is displaced from either its fully opened state or from its partly closed state to its fully closed state. During this closing of the dispenser, the inclined edge of the displacement means (see FIG. 3 and FIG. 4) will engage the abutment surface provided on the left side of the lever arm. During the closing of the dispenser and due to the inclination of the edge of the displacement means the lever arm will be displaced further and further counter-clockwise until the end of the lever arm has passed the tooth of the toothed inner circumference being located in the immediate vicinity of the stop seen in a counter-clockwise direction Then the one end of the lever arm engages this tooth.

During the displacement of the one end of the lever arm from the stop to the tooth in the immediate vicinity of the stop, the lever arm will be pushed along the extension of the lever arm a small distance in the direction towards the distant end of the lever arm because the end of the lever arm has to pass the tooth. The suspension in the fixed member is resilient and will allow the lever arm to be pushed this small distance. The end of the lever arm is now in engagement with the tooth and is being kept biased towards the tooth by means of the spring member. However, in the closed state of the top part the displacement means provided on the inner surface of the top part will prevent the lever arm from displacement clockwise towards the stop. Displacement will only be possible when the inclined edge of the displacement means is being released from abutment with the abutment surface of the lever arm. This will only take place when the release button is activated as described below.

FIG. 8 and FIG. 9 show two sketches of cross sections of the front part of the dispenser, the part comprising the release button. The sketches show how the release button enables use of the dispenser. The release button is intended for a two-step release of the top part in relation to the bottom part. A first step is releasing the top part from a fully closed state as shown in FIG. 1 to a partly closed state such as shown in FIG. 2. This step takes place by pushing one time the release button towards the centre of the dispenser. A second step is releasing the top part from the partly closed state as shown in FIG. 2 to a fully opened state such as shown in FIG. 3. This step takes place by pushing a second time the release button towards the centre of the dispenser.

Initially, when the top part is in its fully closed state, the fully closed state is maintained by an outwardly orientated hook provided at the release button and being in engagement with an inwardly orientated hook provided at a lowermost point of the bottom part such as shown in the first cross section. Pushing the release button one time towards the centre of the dispenser releases the engagement between the two hooks. Because the top part by means of the spring member in the hinged connection (see FIG. 4) is biased towards its opened state, then the top part will start a hinged displacement in relation to the bottom part in an attempt to fully open.

However, the bottom part is not only provided with a lower inwardly orientated hook, but is also provided with an upper inwardly orientated hook. After having released the engagement between the outwardly orientated hook of the release button with and the lower inwardly orientated hook of the bottom part, and after the top part has started the attempt to fully open, then engagement will be established between the hook of the release button and the upper hook of the bottom part such as shown in the second cross section, before the top part reaches its fully opened state.

In this state, the top part is only partly closed. Referring now to FIG. 7 explaining the function of the driving mechanism, in the fully closed state as shown in FIG. 8, the lever arm will be in its displaced state away from the stop of the fixed member and under influence of the spring member and with the end of the lever arm being in engagement with the tooth of the toothed inner circumference being in the immediate vicinity of the stop seen in the counter-clockwise direction. However, in the fully closed state of the top part in relation to the bottom part, the displacement means provided on the inner side of the top part projects through the slot in the cover for the driving mechanism and maintains the lever arm in its displaced state.

When the release button is released one time so that the top part opens to the partly closed state, and the engagement of the hook of the top part shifts from engagement with the lower hook of the bottom part to engagement with the upper hook of the bottom part, then the displacement means is pulled out of the slot in the cover for the driving mechanism. Thereby, the maintaining of the displacement of the lever arm is ended and the lever arm will be displaced clockwise towards the stop on the fixed member. When the lever arm is displaced the end of the lever arm being in engagement with the said tooth of the toothed inner circumference will rotate the toothed inner circumference and thereby also rotate the supporting plate that is supporting the blister pack. Thus, the blister pack is rotated and a blister containing a new tablet to be dispensed is being rotated into place above the outlet in the bottom part.

After the supporting plate, which is supporting the blister pack and thus also the blister pack has been rotated, a new tablet still contained in a blister is ready for dispense. Dispensing of the tablet takes place by pushing the top part downwards towards the bottom part, i.e. forcing the top part from its partly closed state towards its fully closed state. In doing so, the plunger is pushed towards the blister containing the new tablet. When the plunger is pushed towards the blister, firstly the blister pack will be forced down against the supporting plate. Then, the cutting edge provided along the side of the hole in the supporting plate will penetrate the bottom foil of the blister part abutting the supporting plate.

This initial penetration will ease the following dispensing of the tablet. Secondly, the tablet will be forced towards the bottom foil of the blister pack and will exert a force to this bottom foil of the blister pack. Thirdly, this force coming from the user pushing on top of the top part towards its fully closed state drives the tablet out through the bottom foil of the blister pack by bending aside the part of the bottom foil encapsulating the tablet. Fourthly, the tablet is driven further out through the hole in the supporting plate and out through the outlet in the bottom part. Thus, the tablet is dispensed from the dispenser.

Referring to FIG. 9 showing the top part in its partly closed state, and with the hook of the release button in engagement with the upper hook of the bottom part, it will be possible by use of the release button to open the dispenser from the partly closed state of the top part to the fully opened state of the top part. When the top part is in its partly closed state as shown in FIG. 9, pushing of the release button a second time will result in releasing the engagement between the hook of the release button and the upper hook of the bottom part. Thereby, the top part will open to its fully opened state, the opening being assisted by the spring means in the hinged connection.

In the fully opened state, the dispenser may be loaded with a new blister pack by inserting a blister pack into the bottom part onto the supporting plate, or by taking out of a used blister pack and exchanging it by a new blister pack. After having loaded the dispenser with a new blister pack, the top part is forced down towards the bottom part all way down to the fully closed state of the top part, where the hook of the release button is in engagement with the lower hook of the bottom part such as shown in FIG. 8.

Both FIG. 8 and FIG. 9 show that the hole in the supporting plate through which the tablets are dispensed are provided with a land which the back foil of the blister pack abuts when being placed in the apparatus, and when the tablet is being pushed out of the blister. In the embodiment shown in FIG. 8 and FIG. 9, the land is solid and rigid and raised in relation to the supporting plate itself. The land itself may constitute a cutting edge for cutting the back foil of the blister pack or the land may be provided with additional cutting means for cutting the back foil. FIG. 10A–FIG. 10D show embodiments of lands alternative to the land shown in FIG. 8 and FIG. 9, but constituting cutting edges themselves.

FIG. 10A shows a land encircling the hole for dispensing the tablet and having along its circumference an elevated portion converging linear, but alternatively non-linear, towards a top. When the blister pack is being pushed against the land constituting a cutting edge, the top will penetrate the bottom foil of the blister pack and the remaining part of the circumference of the cutting edge will penetrate the foil subsequently at each side of the top.

FIG. 10B shows a land also encircling the hole for dispensing the tablet and having along its circumference an elevated portion converging helically towards a top. When the blister pack is being pushed against the land constituting a cutting edge, the top will penetrate the bottom foil of the blister pack, and subsequently the remaining part of the circumference of the cutting edge will penetrate the foil along the helical decline of the circumference.

FIG. 10C shows a land encircling the hole for dispensing the tablet and having along one half of its circumference an elevated portion converging linear, but alternatively non-linear, towards a top and along the other half of its circumference a lowered portion running in the one and same lower plane. Two steps are provided between the elevated portion and the lowered portion. When the blister pack is being pushed against the land constituting a cutting edge, initially one of or both of the steps will penetrate the bottom foil of the blister pack and subsequently, between the steps, the elevated portion of the circumference of the cutting edge will penetrate the foil.

FIG. 10D shows a land encircling the hole for dispensing the tablet and having along its circumference a highest point form which the circumference is converging helically towards a lowest point. A step is provided between the highest point and the lowest point of the circumference. When the blister pack is being pushed against the land constituting a cutting edge, initially the highest point will penetrate the bottom foil of the blister pack, and subsequently, between the highest point and the lowest point, the cutting edge will penetrate the foil subsequently along the helically converging circumference.

Alternative embodiments of lands may be employed. In the above embodiments, all the lands are continuous in the sense that they constitute actual edges of the land. Alternatively, the lands may be provided with sprigs or the like pointed means constituting more discontinuous edges of the land.

FIG. 11A and FIG. 11B show embodiments of lands alternative to the land shown in FIG. 8 and FIG. 9, and not constituting cutting edges themselves but being provided with cutting means for cutting the back foil of the blister pack.

FIG. 11A shows a flexible supporting plate, where the plate itself is mounted round a central part in the bottom part of the apparatus. The supporting plate is biased towards a raised position by a resilient member such as a helical spring shown. The back foil of the blister pack is intended for abutting the top surface of the supporting plate as described above. The supporting plate has a number of holes provided along a circumference of the supporting plate, also as described above. Underneath the supporting plate, a land is provided protruding upwards from the bottom of the bottom part of the apparatus. Along a circumference of the land a cutting edge is provided being either of the cutting edges described in FIG. 5 or in FIG. 10A–FIG. 10D.

When the blister pack is being pushed downwards, the blister pack will be pushed towards the land by suppressing the biasing force from the resilient member underneath the supporting plate. The land will be pushed to a lowered position where the cutting edge along the circumference of the land will penetrate the hole along the circumference of the supporting plate and subsequently will penetrate the back foil of the blister pack. Further pushing down of the blister pack will further cut the back foil of the blister pack and the tablet will be pushed out of the blister pack through the land and through the hole in the bottom part of the apparatus as previously described.

FIG. 11B shows a non-flexible supporting plate as the one shown in FIG. 11A, where the plate itself is mounted round a central part in the bottom part of the apparatus, but where in the embodiment shown in FIG. 11B, the supporting plate is not biased by a resilient member. The back foil of the blister pack is also intended for abutting the top surface of the supporting plate as described above. The supporting plate also has a number of holes provided along a circumference of the supporting plate, also as described above. Underneath the supporting plate, no land with a cutting edge is provided.

In stead, a cutting means is provided along the circumference of each hole in the supporting plate as also described in FIG. 5. The cutting means in the embodiment shown in FIG. 11B is a preferably metallic pointed flap extending upwards through each of the holes in the supporting plate along the inner circumference of the holes. The pointed flab is provided by punching a hole in a preferably metallic plate and using part of the stamped out part as a flap by keeping this part attached to the plate. Other materials than metal may be employed as the plate with flaps, perhaps a plastic plate made of plastic having a high strength and durability. The figure shows that the preferably metallic plate is secured to a lower surface of the supporting plate. Thus, the supporting plate and the preferably metallic plate provided with the flaps constitute an integrate member with the flaps of the preferably metallic plate protruding through the holes in the supporting plate.

When the blister pack is being pushed downwards, the blister pack will be pushed towards the top surface of the supporting plate. The back foil of the blister pack will then be penetrated by the cutting means constituted by the pointed flap protruding through the hole in the supporting plate. Once the back foil is penetrated, it is easier to push out the tablet through the remainder of the back foil covering the blister in question.

FIG. 11C shows an embodiment according to the embodiment of the combined supporting plate and plate with the flaps as shown in FIG. 11B. However, a special plunger is provided. The special plunger consists of an outer plunger having a cylindrical shape and an inner plunger being displaceable within the outer plunger. The outer plunger has a lower edge directed towards the circumference of the one hole in the supporting plate. The outer plunger and the inner plunger preferably have a circular cross-section. At least an outer diameter of the outer plunger is greater than an inner diameter of the hole in the supporting plate. The inner plunger has a lower surface directed towards the hole in the supporting plate. The outer diameter of the inner plunger is equivalent to an inner diameter of the outer plunger and is smaller than the inner diameter of the hole in the supporting plate. By means of a resilient member such as a helical spring as shown, the inner plunger is biased towards a raised position in relation to the outer plunger.

The function of the combined outer and inner plunger is the following. The plunger is intended to substitute the plunger described with reference to FIG. 3. Accordingly, the plunger is part of the top part of the dispensing apparatus, and does not constitute an individual part. When the top part is pushed downwards in order to push out a tablet form the blister pack, then initially the lower edge of the outer plunger will push and hod down the back foil of the blister pack towards the top surface of the supporting plate. When doing so, it is fully assured that the back foil will be penetrated by the pointed flap protruding through the hole in the supporting plate. Subsequently, the inner plunger during suppression of the biasing of the resilient member will push out the tablet from the blister and through the hole in the supporting plate. By providing a plunger with a function like the one described, a certainty is obtained that the back foil of the blister pack is penetrated before the tablet is pushed out of the blister pack. Thus, the ease of pushing out the tablet, which is obtained when the back foil is initially penetrated, is assured every time a tablet is to be dispensed from the apparatus.

The dispenser may be used for many types of tablets in a blister pack. One example is tablets used by former smokers to avoid smoking, the tablets containing a small amount of nicotine. Taking of such tablets need not be taken using a dosage plan, the tablets may be taken whenever the user feels the need. Another example is tablets preventing pregnancy. These tablets must be taken every day. A further example may be tablets as medication of diabetics, heart trouble or any other diseases which may not be lethal if one of the tablets are not taken, but which however needs a regular dosage plan. A still more used medication is antidepressive medication which need be taken regularly in order to limit depressions, and which have to be taken at different time intervals during start up of the medication, during regular medication and during finishing of the medication. A still further example may be tablets of medication of more severe diseases, where it may be lethal if the tablets are not taken at prescribed times.

What is claimed is:

1. Method for dispensing of tablets from an apparatus constituting a container and a dispenser for tablets in a blister pack, said method comprising the steps of releasing the apparatus from a locked state to an unlocked state, said unlocked state preferably being a partly closed state, displacing a top part of the apparatus in relation to a bottom part from the unlocked state towards the locked state by pushing the top part towards the bottom part, thereby engaging a driving mechanism without mutual displacement between the blister pack and the push out means, activating push out means in the apparatus for dispensing of at least one tablet from the apparatus through the outlet, reverting the apparatus from the locked state towards the unlocked state by lifting the top part in relation to the bottom part, thereby disengaging the driving mechanism, and thereby establishing a mutual displacement between the blister pack and push out means so as to place a new tablet to be dispensed above an outlet in the apparatus.

2. Method according to claim 1, said method comprising the further step of unlocking the apparatus by use of one hand only by manually operating the release button and subsequently locking the apparatus by use of one hand only by manually operating the top part in relation to the bottom part so that said method is capable of being performed using only one hand.

3. Method for dispensing of tablets from an apparatus constituting a container and a dispenser with means for pushing out of tablets in a blister pack, said method comprising the steps of activating push out means in the apparatus for dispensing of at least one table from the apparatus, preferably by pushing a top part of the apparatus towards a bottom part of the apparatus and thereby pushing at least one tablet through an outlet in the apparatus, activating a manually operated activation means of the apparatus simultaneously with, alternatively subsequent to the pushing out of the tablet, said manually operated activation means preferably being the top part of the apparatus, the manually operated activating means, when being activated, thereby activating automatic displacement means, and the automatic displacement means, when being activated, thereby activating automatic driving means, said driving means establishing, as regards time separate from the activation of the manually operated activation means and of the displacement means, a mutual displacement between the blister pack and the push-out means.

4. Method according to claim 3, said method comprising the further step of operating the activation means of the apparatus by manually activating a top part in relation to a bottom part of the apparatus so that said method is capable of being performed using the palm of the hand and not using the fingers of the hand.

5. Apparatus for dispensing of tablets from a blister pack, said apparatus comprising a compartment for containing the blister pack with a number of tablets enclosed therein, and comprising means at least for pushing the tablet out of the blister pack, and comprising a top part and the bottom part constituting the compartment for containing the blister pack, the top part and the bottom part having a locked state and an unlocked state, push out means for pushing the tablets out of the blister pack, said push out means being activated upon displacement of the top part in relation to the bottom part from the unlocked state towards the locked state, an outlet in the apparatus, preferably in the bottom part, for dispensing of at least one tablet from the blister pack out of the apparatus, a driving mechanism being engaged upon displacement of the top part in relation to the bottom part from the unlocked state towards the locked state, said driving mechanism being disengaged upon displacement of the top part in relation to the bottom part from the locked state towards the unlocked state, thereby establishing a mutual displacement between the blister pack and the push out means so as to place a new tablet to be dispensed above the outlet.

6. Apparatus according to claim 5, where the apparatus is locked in the locked state of the top part and the bottom part, and said apparatus being provided with a release button for unlocking the apparatus from the locked state, subsequent to said unlocking the top part is being displacable in relation to the bottom part.

7. An apparatus according to claim 5, where the automatic displacement means is mechanical displacement means, alternatively is electrical displacement means, further alternatively is magnetic displacement means.

8. Apparatus according to claim 5, the automatic displacement means being intended for rotational displacement of the blister pack.

9. Apparatus according to claim 5, the automatic displacement means being intended for linear displacement of the blister pack.

10. Apparatus according to claim 5, the automatic displacement means being mechanical displacement means and comprising a first part being in engagement with the blister pack, a second part being in engagement with, alternatively constituting a part of, the first part and comprising a stepwise division, and a third part for displacing the second part a number of steps when the third part is activated.

11. Apparatus according to claim 10, wherein the third part is activated manually and that the first and second part is displaced automatically when the third part is activated.

12. Apparatus according to claim 8, where the automatic displacement means are mechanical displacement means for displacing the blister pack comprises a ratchet mechanism.

13. Apparatus according to claim 8, where the automatic displacement means are mechanical means for displacing the blister pack comprises a curvature guiding mechanism.

14. Apparatus according to claim 6, wherein the compartment consists of a bottom part and a top part, said bottom part and said top part being capable of being mutually displaced towards each other and mutually displaced apart from each other, and that activation of the third part takes place when the bottom part and the top part is mutually displaced.

15. Apparatus according to claim 14, where the bottom part and the top part are joined to each other by a hinged connection and where mutual displacement of the bottom part in relation to the top part takes place by an angular displacement between the bottom part and the top part around an axis of rotation of the hinged connection.

16. Apparatus according to claim 14, where the bottom part and the top part are joined to each other by a telescopic connection and where mutual displacement of the bottom part in relation to the top part takes place by a linear displacement between the bottom part and the top part along a longitudinal axis of the telescopic connection.

17. Apparatus according to claim 14, where spring means are placed between the bottom part and the top part, said spring means maintaining the bottom part and the top part biased in a direction away from each other when not being mutually displaced.

18. Apparatus according to claim 14, where the apparatus comprises a plunger for pushing at least one tablet out of the blister pack, and said plunger constituting an integral part of the top part of the of the compartment, alternatively said plunger constituting an integral part of the bottom part of the of the compartment.

19. Apparatus according to claim 14, where the outlet for dispensing of the at least one tablet out of the apparatus constitutes an integral part of the bottom part of the compartment, alternatively said outlet for dispensing of the at least one tablet out of the apparatus constituting an integral part of the top part of the compartment.

20. Apparatus according to claim 5, said apparatus comprising a compartment for containing the blister pack with a number of tablets enclosed therein, and comprising means at least for pushing the tablet out of the blister pack, and comprising an outlet for dispensing of at least one tablet from the blister pack and further out of the apparatus and said apparatus furthermore comprising a land that is provided with cutting means, that the blister pack is intended for abutting said cutting means when the apparatus is activated, and that the cutting means is intended for cutting of the blister pack before the at least one tablet is dispensed out through the outlet.

21. Apparatus according to claim 20, where the land is elastically compressible, and where a cutting means is hidden in the land when the land is in a not compressed state, and where the cutting edge is visible in the land when the land is in a compressed state, that the blister pack is intended for initially abutting said land and subsequently is intended for abutting said cutting means when the apparatus is activated, and that the cutting means is intended for cutting of the blister pack before the at least one tablet is dispensed out through the outlet.

22. Apparatus according to claim 20, where the a supporting plate is provided for supporting the blister pack on the top surface of the supporting plate, said supporting plate having a number of through-holes and being provided with cutting means, said supporting plate being elastically compressible, and where the cutting means when the supporting plate is in a not compressed state does not protrude through one of said holes in the supporting plate, and where the cutting means when the supporting plate is in a compressed state does protrude through one of said holes in the supporting plate, and where the cutting means is intended for cutting of the blister pack before the at least one tablet is dispensed out through the outlet.

23. Apparatus according to claim 20, where the a supporting plate is provided for supporting the blister pack on the top surface of the supporting plate, said supporting plate having a number of through-holes and being provided with cutting means, said cutting means constituting an integrate part of the supporting plate and being positioned in the immediate vicinity of the edge of the through-holes of the supporting plate, and said cutting means preferably being made of the same material as the supporting plate, alternatively being made of another material and being secured to the supporting plate.

24. Apparatus according to claim 20, where the a supporting plate is provided for supporting the blister pack on the top surface of the supporting plate, said supporting plate having a number of through-holes and being provided with cutting means, said cutting means constituting an integrate part of the supporting plate and being positioned along an inner circumference of the through-holes of the supporting plate, and said cutting means preferably being made of another material than the supporting plate and being secured to the supporting plate, alternatively being made of the same material as the supporting plate.

25. Apparatus according to claim 20, where the a supporting plate is provided for supporting the blister pack on the top surface of the supporting plate, said supporting plate having a number of through-holes and being provided with cutting means, said cutting means constituting an integrate part of the supporting plate and being positioned in the immediate vicinity of the edge of the through-holes of the supporting plate, and said cutting means preferably being made of another material than the supporting plate and being secured to the supporting plate, alternatively being made of the same material as the supporting plate.

26. Apparatus according to claim 24, where the cutting means is made of another material than the supporting plate, and where the cutting means is made as part of a plate, preferably a metal plate, being secured to a lower surface of the supporting plate, and the cutting means protruding along an inner circumference of the through-holes of the supporting plate.

27. Apparatus according to claim 24, where the cutting means is made of another material than the supporting plate, and where the cutting means is made as part of a plate, preferably a metal plate, being secured to a top surface of the supporting plate, and the cutting means extending upwards form the top surface in the immediate vicinity of the edge of the through-holes of the supporting plate.

28. Apparatus according to claim 5, where dispensing of the tablets take place by means of a two-part plunger comprising an outer plunger and an inner plunger, and where the outer plunger is intended for initially pushing the blister pack towards a land, and where the inner plunger is intended for subsequently pushing a tablet out of the blister pack.

29. Apparatus according to claim 5, where an orifice of an exterior container is provided at an outer surface of the apparatus just on an outside of the outlet compared to an inside of the outlet turned towards the compartment for the blister pack, and that the container has a size capable of containing at least one tablet after having been let out of the outlet.

30. Apparatus according to claim 29, where the container is capable of being secured to the apparatus, preferably by providing an orifice of the container and the outside of the outlet with a screw mechanism.

31. Apparatus according to claim 5, where a recess is provided in an outer surface of the apparatus just on an outside of the outlet compared to an inside of the outlet turned towards the compartment for the blister pack, and that the recess has a size capable of containing at least one tablet after having been let out of the outlet.

32. Apparatus according to claim 31, where the recess has a height between the outside of the outlet and the surface of the apparatus, the height being greater than a height of the at least one tablet to be dispensed.

33. Use of an apparatus according to claim 5, for dispensing of tablets from a blister pack contained in the apparatus.

34. Apparatus according to claim 9, where the automatic displacement means are mechanical displacement means for displacing the blister pack comprises a ratchet mechanism.

35. Apparatus according to claim 9, where the automatic displacement means are mechanical means for displacing the blister pack comprises a curvature guiding mechanism.

36. Apparatus according to claim 10, where the automatic displacement means are mechanical displacement means for displacing the blister pack comprises a ratchet mechanism.

37. Apparatus according to claim 10, where the automatic displacement means are mechanical means for displacing the blister pack comprises a curvature guiding mechanism.

38. Apparatus according to claim 7, wherein the compartment consists of a bottom part and a top part, said bottom part and said top part being mutually displaced towards each other and mutually displaced apart from each other, and that activation of the third part takes place when the bottom part and the top part is mutually displaced.

39. Apparatus according to claim 8, wherein the compartment consists of a bottom part and a top part, said bottom part and said top part being capable of being mutually displaced towards each other and mutually displaced apart from each other, and that activation of the third part takes place when the bottom part and the top part is mutually displaced.

40. Apparatus according to claim 9, wherein the compartment consists of a bottom part and a top part, said bottom part and said top part being capable of being mutually displaced towards each other and mutually displaced apart from each other, and that activation of the third part takes place when the bottom part and the top part is mutually displaced.

41. Apparatus according to claim 10, wherein the compartment consists of a bottom part and a top part, said bottom part and said top part being capable of being mutually displaced towards each other and mutually displaced apart from each other, and that activation of the third part takes place when the bottom part and the top part is mutually displaced.

42. Apparatus according to claim 11, wherein the compartment consists of a bottom part and a top part, said bottom part and said top part being capable of being mutually displaced towards each other and mutually displaced apart from each other, and that activation of the third part takes place when the bottom part and the top part is mutually displaced.

43. Apparatus according to claim 12, wherein the compartment consists of a bottom part and a top part, said bottom part and said top part being capable of being mutually displaced towards each other and mutually displaced apart from each other, and that activation of the third part takes place when the bottom part and the top part is mutually displaced.

44. Apparatus according to claim 13, wherein the compartment consists of a bottom part and a top part, said bottom part and said top part being capable of being mutually displaced towards each other and mutually displaced apart from each other, and that activation of the third part takes place when the bottom part and the top part is mutually displaced.

* * * * *